United States Patent [19]

Sheppard

[11] 4,024,927

[45] May 24, 1977

[54] LOWERING DEVICE

[76] Inventor: John B. Sheppard, 2939 Riverside Drive, Burbank, Calif. 91505

[22] Filed: Dec. 22, 1975

[21] Appl. No.: 643,008

[52] U.S. Cl. ..... 182/5; 188/65.4

[51] Int. Cl.[2] ..... B65H 59/10; A62B 1/14

[58] Field of Search ..... 182/5, 6, 7; 188/65.4, 188/65.2, 65.3

[56] References Cited

UNITED STATES PATENTS

| | | | |
|---|---|---|---|
| 191,115 | 5/1922 | Clark | 182/5 |
| 703,236 | 6/1902 | Christ et al. | 188/65.4 |
| 784,864 | 3/1905 | Landis | 188/65.3 |
| 3,949,832 | 4/1976 | Hunter | 182/7 |

*Primary Examiner*—Reinaldo P. Machado
*Attorney, Agent, or Firm*—William P. Green

[57] ABSTRACT

A lowering device including a unit which is adapted to slide downwardly at a controlled rate along a rope or other flexible line and which contains a circuitous passage through which the line extends to introduce friction between the line and the unit. In the preferred arrangement, two clamping devices controlled by rotatable collet sleeves are provided at opposite ends of the passage for controllably varying the rate of descent of the unit along the line, and the circuitous passage is formed by a tube contained within a case and surrounded by a mass of resinous plastic material hardened in place. The tube and contained circuitous passage may first be coiled in one direction, and then be coiled in the opposite direction, in a relation preventing twisting of the line as the device moves downwardly therealong.

17 Claims, 8 Drawing Figures

LOWERING DEVICE

BACKGROUND OF THE INVENTION

This invention relates to improved devices for lowering a person, persons or other load from one level to another, as for instance in escaping from an upper floor of a building during a fire or other emergency. Certain features of the invention have been shown in Disclosure Document No. 031598, filed in the U.S. Patent Office on May 6, 1974.

Various emergency escape devices have been proposed in the past of a type utilizing a unit which is adapted to support an escaping person or other load, and which is slidable downwardly along a flexible line at a controlled rate in a manner gradually lowering the person to a desired level. For example, such devices have been shown in U.S. Pat. Nos. 191,115, 207,856, 210,928, 283,702, 289,163, 311,039, and 504,868. In these devices, the flexible line in passing through or past the lowerable unit, is required to follow a circuitous path, in a manner introducing a substantial amount of friction between the line and the unit, and thereby resisting downward movement of the unit sufficiently to assure its descent at a safe speed. The circuitous path in some cases has been formed and defined by a coiled tube. For regulating the rate of descent, it has been proposed to provide a clamping device at the lower end of the circuitous path acting to resist movement of the line through that device and thereby vary the friction between the line and the tube or other structure defining the circuitous path.

SUMMARY OF THE INVENTION

The present invention provides improved lowering devices of the above discussed general type, having greater versatility, convenience of operation and handling, and reliability than the units of the mentioned prior art. For one thing, the invention provides a unique type of friction adjusting device which includes a sleeve disposed about the flexible line at a lower end of the unit and is adapted to vary the friction on the line in accordance with rotary movement of the sleeve about the line. More particularly, this sleeve may act against a plurality of gripping fingers which are cammed inwardly against and into clamping engagement with the line by rotation of the sleeve.

Preferably, two devices for engaging and resisting movement of the line are provided at opposite ends of the means which define the circuitous path along which the line advances, to control movement of the unit in opposite directions respectively along the line, so that after a first person has lowered himself to ground level by the line a next successive user can then pull the line and carried unit upwardly to an upper floor location and suspend the line in reversed condition, from what was originally its lower end, to enable that second user to slide downwardly along the line in the reversed condition. Thus, a series of persons may use the device without the necessity for pulling the line forcibly through the frictionally engaged element between uses.

In one form of the invention, a tube through which the line extends is coiled generally helically to provide the appropriate frictional resistance to movement of the line. In such an arrangement, the invention contemplates preferably forming the tube to have one portion extending helically in a first circular direction, and a second portion coiled generally helically in the opposite circular direction, so that a tendency for one of these helical portions to twist the flexible line is counteracted by the other portion in a manner reducing or eliminating the overall twisting effect.

An additional feature of the invention resides in a unique arrangement permitting the use, for defining the circuitous path along which the line extends, of a tube which may be formed of a relatively low strength material which by itself would not be strong enough to resist deformation under the forces exerted on the tube by the line when a substantial weight is suspended from and being lowered by the device. For this purpose, I use in conjunction with the low strength coiled or otherwise deformed tube a supporting structure which prevents deformation of the tube from its desired shape. This structure may be a mass of material, such as an appropriate polymerized resin, lead, or the like, hardened in place about the tube, and desirably within an outer case, to permanently retain the tube in a desired set condition.

BRIEF DESCRIPTION OF THE DRAWINGS

The above and other features and objects of the invention will be better understood from the following detailed description of the typical embodiments illustrated in the accompanying drawings in which.

DESCRIPTION OF THE PREFERRED EMBODIMENTS

Figure 1:
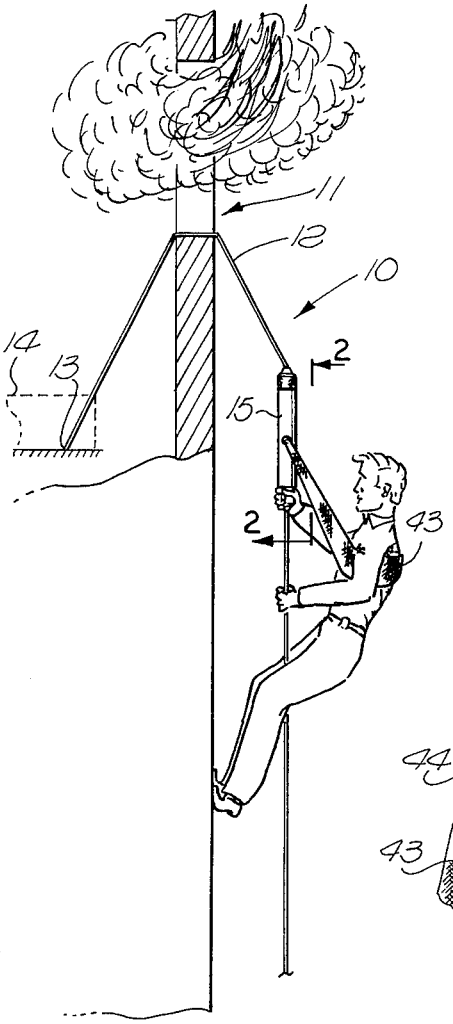
FIG. 1 is a side view of a person using a device embodying the invention to escape from an upper floor of a burning building.
Figure 4:
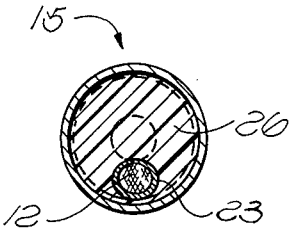
FIG. 4 is a horizontal section on line 4—4 of FIG. 3.

Referring first to FIG. 1, I have illustrated in that figure the use of a device 10 embodying the invention for lowering a person from an upper floor 11 of a multiple story building to ground level. The device includes an elongated flexible line 12, whose upper end 13 is adapted to be tied or otherwise connected to any suitable fixed structure 14 at the upper floor level, and which line carries a unit 15 received about the line and adapted to support a user or other load and to slide slowly down the line to the ground level.

Figure 2:
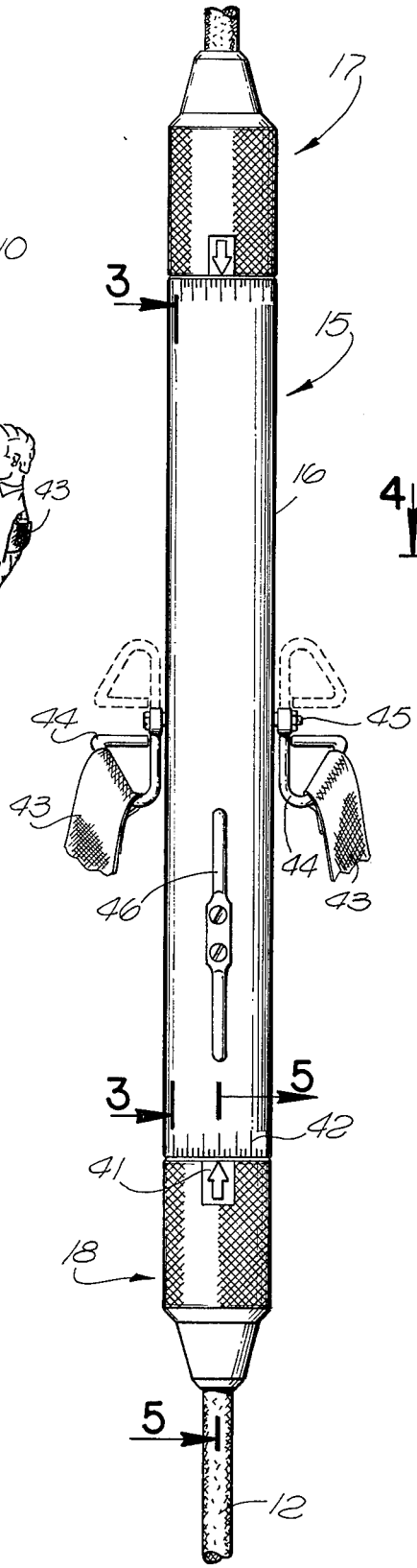
FIG. 2 is a greatly enlarged view of the lowerable unit of FIG. 1, taken on line 2—2 of FIG. 1.
Figure 3:
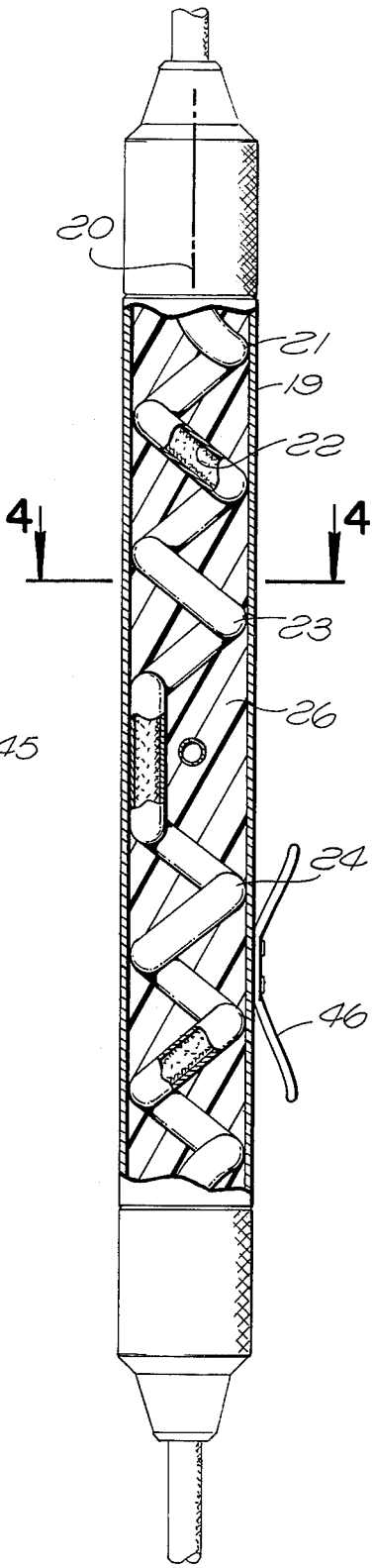
FIG. 3 is a vertical section taken on line 3—3 of FIG. 2.

As seen in FIGS. 2 and 3, the unit 15 includes a main body secton 16 having two adjusting devices 17 and 18 at its opposite ends for regulating the rate of descent of unit 15 along the line. The main section 16 has an outer cylindrical case 19, typically formed of an appropriate rigid metal such as steel, aluminum, brass, or the like, or a resinous plastic, fiberglass, or other material, and centered about an axis 20 which is vertical in the position of the device illustrated in FIGS. 2 and 3. An elongated tube 21 extends downwardly through case 16, and contains and defines a circuitous passage 22 within which flexible line 12 is a fairly close fit, to resist longitudinal advancement of the line through tube 21 by virtue of the friction between the line and the tube. The tube may be of conventional circular cross-section, and in the FIGS. 1 to 6 form of the invention has an upper portion 23 which is coiled helically in a first direction about axis 20, and a lower portion 23 which is coiled helically in the opposite direction about that axis. The tube reverses its direction of helical advancement at the location of a vertically central or intermediate portion 25 of the tube. The upper and lower portions 23 and 24 of the tube have the same number of turns, and are of the same radius, pitch, etc. so that any tendency for line 12 to be twisted by passage through the upper coiled portion of the tube is counteracted by reverse helical advancement of the line through lower portion 24. This protection against twisting is helpful when used with any type of line, but is especially desirable when the line itself is of twisted construction. It is contemplated that any convenient type of flexible line may be employed, such as an appropriate high strength rope of nylon or other material, or a suitable flexible cable of metal or any other desired material.

The tube 21 is in more instances formed of a material which, in the wall thickness employed, does not have sufficient strength to permanently maintain the illustrated coiled condition under the forces exerted by the line in use. As will be apparent, the weight of the user's body tends to cause the line within tube 21 to assume a straightened condition, and therefore tends to straighten the coil tube. The tube may typically be formed of copper, aluminum, or a resinous plastic material or the like, which if not reinforced in some way could not resist the straightening forces, and therefore would not serve properly the desired function of maintaining permanently the circuitous path which the line is required to follow.

In order to prevent such straightening or distortion of the relatively weak tube 21 under the forces exerted by the line, I provide within case 19 a mass of reinforcing material 26, which fills the entire space within the case and about tube 21, and which is considerably stronger than tube 21 and positively prevents deformation of the tube under the influence of the line exerted forces. The material 26 may be hardened in place within the case and about the tube, and more specifically is preferably an appropriate resinous plastic material, such as polyurethane, or the like, or a suitable cast metal, such as lead, or any other appropriate substance having sufficient strength to prevent alteration of the shape of the tube.

Figure 5:
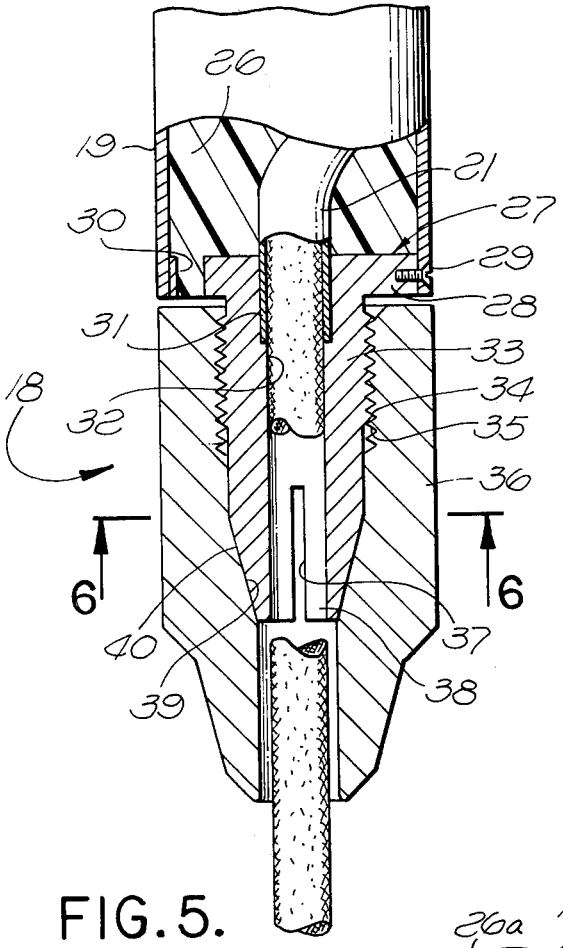
FIG. 5 is a fragmentary vertical section taken on line 5—5 of FIG. 2.

The upper and lower ends of case 19 are partially closed by two similar members 27, one of which is shown in FIG. 5, which members form portions of the adjusting mechanisms 17 and 18 at the top and bottom of the device. As seen in FIG. 5, each of the members 27 has a circular portion 28 which forms a transverse wall across the upper or lower end of case 19, and which is suitably secured in place as by a number of screws one of which is represented at 29 in FIG. 5. One of the members 27 contains an aperture 30 through which the reinforcng material 26 is injected in liquid form, to be polymerized or otherwise hardened or cured in place within the case.

The opposite ends of tube 21 have portions 31 extending into and retained within axial passages 32 formed in the parts 27 respectively. Each of the members 27 has an axially projecting tubular portion 33 through which the passage 32 extends, and having external threads 34 engageable with internal threads 35 on an adjusting sleeve 36. The extremity of the tubular portion 33 of each of the members 27 has a number of circularly spaced axial slits 37 dividing the end portion of the part 27 into a series of axially projecting fingers 38 which are radially constrictable against line 12 but tend by their inherent resilience to resist such constriction and return to the condition illustrated in FIG. 5. Sleeve 36 has an annular internal cam surface 39 which is engageable with external frusto-conical cam surfaces 40 on fingers 38 to deflect those fingers inwardly against the line in response to rotary adjusting movement of the sleeve as permitted by threads 34 and 35. Parts 33 and 36 are of course preferably rigid except for the discussed resilient deformability of the end fingers 38 of part 33. The rotary setting of each of the sleeves 36 is indicated by markings which may include an index arrow 41 on the sleeve and a coacting scale 42 marked off in weights to indicate the proper rotary setting of each sleeve for persons of different weights.

The user of the device, or any other load to be supported by the device, is suspended in any convenient manner from case 19, as by a typically illustrated suspension strap 43 (FIG. 1) whose opposite ends may be connected to a pair of loops 44 secured to the opposite sides of case 19. In lieu of the illustrated strap 43, any convenient type of harness or other support capable of holding an individual or load may be substituted. The connector loops 44 may pivot about their mounting pins 45 between the broken line and full line positions of FIG. 2 to support the user or load in two relatively inverted positions of unit 15. Also, the case may carry on its exterior a member 46 to which an end of the line may be connected to additionally retain the unit against movement downwardly from a particular position on the line.

In using the illustrated lowering device, an individual may first connect end 13 to any convenient fixed structure in the upper floor 11 of a building, and then allow the opposite end of the line to fall downwardly toward the ground surface. After the line is thus positioned, with the unit 15 at the upper level, the user assumes the position illustrated in FIG. 1, and allows himself to gradually slide downwardly along the line. The rate of descent may be varied by adjusting the lower one of the two sleeves 36, to resist upward movement of the line through the collet structure within that sleeve, and thereby maintain the line at a controlled tension within tube 21. The greater the resistance to movement offered by the lower one of the two adjusting devices (unit 18 in FIG. 2), the greater the friction between the line and tube 21, and therefore the slower the rate of descent of the device along line 12. The upper one of the two adjusting mechanisms (17 in FIG. 2) is preferably left in a condition in which it offers substantially no resistance to downward movement of the line through that device.

After a first user reaches the ground level and has disconnected himself from the supporting strap or harness 43, a next successive person at the upper floor level 11 pulls the line and the attached device 15 upwardly to the level 11, and then connects its opposite end to the structure 14 and allows the end 13 to fall downwardly to the ground level. The device 15 is then used by that second person to slide downwardly along the line in a reverse direction relative to the line, and with the second one of the two adjusting mechanisms 17 or 18 then being at the bottom of the device and being used to control the rate of descent. After the second person has reached the ground level, a next user can pull the entire device back up to the upper level and again connect the first of the ends to the structure 14, to slide downwardly along the line in the same manner as the first user, etc. In this way, successive users slide the unit 15 in opposite directions along the line 12, and there is no necessity for forcing this device from one end of the line back to its original end between uses.

Figure 8:
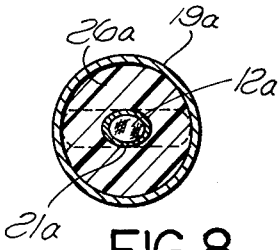
FIG. 8 is a transverse or horizontal section taken on line 8—8 of FIG. 7.
Figure 6:
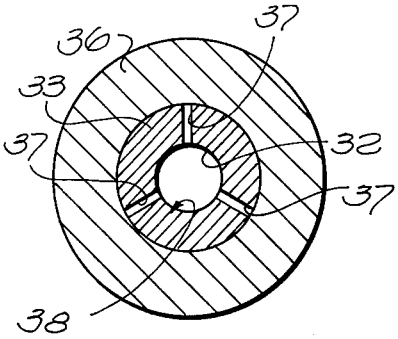
FIG. 6 is a horizontal section taken on line 6—6 of FIG. 5.
Figure 7:
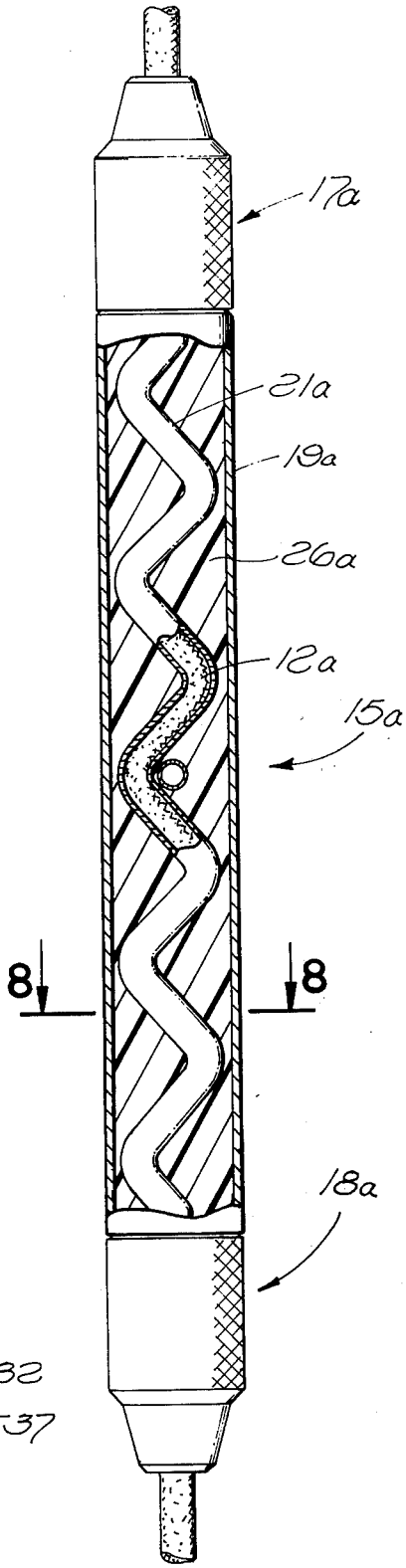
FIG. 7 is a view similar to FIG. 3, but showing a variational form of the invention.

FIGS. 7 and 8 show a variational arrangement which may be considered as identical with that of FIGS. 1 to 6 except that the tube 21*a* within case 19*a* and the reinforcing material 26*a* is of zigzag configuration rather than the coiled shape shown in FIG. 3 and discussed above. This zigzag shape provides a circuitous path serving the purpose of the coiled path of FIG. 3, and introducing friction with respect to line 12*a* for resisting movement of the device 15*a* downwardly along the line. As in the first form of the invention, the device may slide in either direction along line 12*a*, with the resistance and rate of descent being controlled by the user by adjustment of whichever of the sleeve and collet assemblies 17*a* or 18*a* is at the lower end of the device during a particular use.

Figure 9:
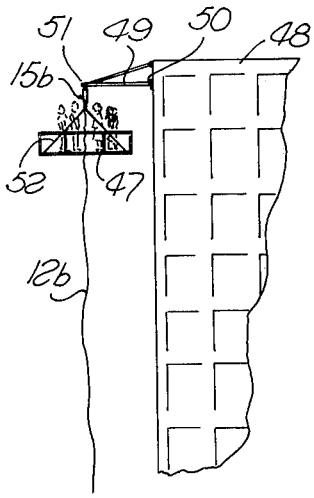
FIG. 9 is a somewhat diagrammatic representation of another variational arrangement.

FIG. 9 shows schematically another adaptation of the invention, in which a platform 47 is provided of a size capable of supporting and lowering a number of persons simultaneously from an upper floor of a building 48 to ground level. To support the platform, the building may have a permanently or temporarily installed arm 49, which may be connected pivotally to the building at 50 to swing outwardly from a retracted position to the illustrated outwardly projecting position when the device is to be utilized. A line 12*b* corresponding to the lines 12 and 12*a* of the first two forms of the invention may have its upper end connected to the outer end of arm 49 at 51, with a device 15*b* corresponding essentially to the devices 15 and 15*a* of the first two forms of the invention being received about and slidable downwardly along line 12*b*. Platform 47 may be supported from the device 15*b* in convenient manner, as by cables 52 extending from the device 15*b* to the corners of the platform, and with the device 15*b* being held at a level rendering it accessible for actuation of its adjusting mechanism corresponding to one of the devices 17 or 18 of FIG. 2 by one of the persons on the platform. Thus, in an emergency or on any other occasion when it is desired to utilize the device, a number of persons may step onto the platform at the elevated level illustrated in FIG. 8, and the platform may then be allowed to move gradually downwardly along line 12*b* to the ground level, with the rate of descent being controlled by actuation of the adjusting collet mechanism. Because of the greater weight suspended by the device of FIG. 8, the tube 21 or 21*a* within unit 15*b* is preferably shaped to have a greater length and more helical turns, zigzag deformations, or other changes in direction along its length to increase the friction between the tube and line sufficiently to compensate for the added weight and prevent too rapid lowering of the platform.

While certain specific embodiments of the present invention have been disclosed as typical, the invention is of course not limited to these particular forms, but rather is applicable broadly to all such variations as fall within the scope of the appended claims.

I claim:

1. A lowering device comprising:
a flexible line adapted to be connected at one end to a support structure and to hang downwardly therefrom;
a unit carried by said line and slidable downwardly therealong; and
means for supporting a person or other load from said unit;
said unit containing and defining a circuitous passage through which said line extends in a relation introducing friction between the line and unit to slow the descent of the unit along the line;
said circuitous passage in extending through said unit being shaped to first advance generally circularly in one direction, and then advance generally circularly in the opposite direction to avoid or reduce twisting of the line.

2. A lowering device as recited in claim 1, in which said unit includes an elongated tube containing said passage through which the line extends and bent to advance first in said one circular direction and then in said opposite circular direction.

3. A lowering device as recited in claim 1, in which said passage advances generally helically in said first circular direction through a plurality of turns and then advances generally helically in said opposite direction.

4. A lowering device as recited in claim 1, in which said unit includes an elongated tube cntaining and forming said passage and shaped to first advance generally helically in said one circular direction about an axis and through a plurality of turns, and then reverse direction to advance generally helically in the opposite circular direction and essentially about said axis through the same number of turns.

5. A lowering device as recited in claim 1, in which said passage advances through substantially the same number of turns in said one direction as in said opposite direction.

6. A lowering device comprising:
a flexible line adapted to be connected at one end to a support structure and to hand downwardly therefrom;
a unit carried by said line and slidable downwardly therealong; and
means for supporting a person or other load from said unit;
said unit containing an elongated tube through which said line extends and which is shaped to follow a circuitous path for introducing friction between the line and tube to slow the downward descent of the unit; and
a structure which is stronger than the tube and is positioned to prevent straightening of the tube by forces exerted by the line in use and thereby maintain the circuitous configuration of the tube and the frictional effect resultant therefrom.

7. A lowering device as recited in claim 6, in which said structure includes a mass of material hardened in place adjacent said tube.

8. A lowering device as recited in claim 6, in which said structure includes a mass of resinous plastic material hardened in place about said tube to maintain its shape.

9. A lowering device as recited in claim 6, in which said unit includes an outer case surrounding said tube; said structure including a mass of material hardened in place within said case and about said tube to maintain the circuitous shape of the tube.

10. A lowering device as recited in claim 9, in which said tube first advances generally helically in one direction essentially about a predetermined axis and then advances generally helically in the opposite circular direction essentially about said axis to avoid or minimize twisting of the line.

11. A lowering device comprising:

a flexible line adapted to be connected at one end to a support structure and to hang downwardly therefrom;

a unit carried by said line and slidable downwardly therealong; and means for supporting a person or other load from said unit;

said unit containing and defining a circuitous passage through which said line extends in a relation introducing friction between the line and unit to slow the descent of the unit along the line;

said unit including a sleeve disposed about said line at one end of said passage and mounted to be adjustably turned about the line, and means actuable by said sleeve to variably resist movement of the line therethrough in accordance with the rotary positioning of the sleeve.

12. A lowering device as recited in claim 11, in which said last mentioned means include a plurality of clamping fingers within the sleeve adapted to be cammed inwardly by the sleeve upon rotary movement thereof to variably resist movement of the line therethrough.

13. A lowering device as recited in claim 12, including markings indicating the rotary setting of said sleeve.

14. A lowering device as recited in claim 11, including markings indicating the rotary setting of said sleeve and thereby indicating the resistance offered to movement of the line therethrough.

15. A lowering device comprising:

a flexible line adapted to be connected at one end to a support structure and to hang downwardly therefrom;

a unit carried by said line and slidable downwardly therealong; and means for supporting a person or other load from said unit;

said unit containing and defining a circuitous passage through which said line extends in a relation introducing friction between the line and unit to slow the descent of the unit along the line;

said unit including two devices engageable with said line at opposite ends respectively of said passage and each offering resistance to movement of the line therepast, and each being adjustable to vary said resistance, so that said two devices can control descent of said unit along said line in opposite directions respectively;

each of said two devices including a plurality of fingers adjustably tightenable inwardly against different sides of said line, and a camming sleeve disposed about said fingers and threadedly mounted for rotary adjusting movement and acting upon such rotary movement to variably cam said fingers against the line.

16. A lowering device as recited in claim 15, in which said unit includes an elongated case having said devices mounted to opposite ends thereof, a tube contained within said case and defining and containing said passage and shaped to give the passage said circuitous configuration, and a mass of resinous plastic material hardened in place within the case and about said tube to maintain the tube in its circuitous shape.

17. A lowering device as recited in claim 15, in which said tube and the contained passage advance first generally helically in one direction essentially about a predetermined axis and through a predetermined number of turns, and then reverse direction to advance in the opposite circular direction generally helically essentially about said axis and through the same number of turns to prevent twisting of the line in use.

* * * * *